US009003668B2

(12) United States Patent
Landwehr

(10) Patent No.: US 9,003,668 B2
(45) Date of Patent: Apr. 14, 2015

(54) HAND CUTTER WITH BLADE GUARD

(71) Applicant: Thomas Jay Landwehr, Green Bay, WI (US)

(72) Inventor: Thomas Jay Landwehr, Green Bay, WI (US)

(73) Assignee: Ritesafety Products International, LLC, Green Bay, WI (US)

( * ) Notice: Subject to any disclaimer, the term of this patent is extended or adjusted under 35 U.S.C. 154(b) by 98 days.

(21) Appl. No.: 13/654,523

(22) Filed: Oct. 18, 2012

(65) Prior Publication Data

US 2014/0109413 A1 Apr. 24, 2014

(51) Int. Cl.

| | |
|---|---|
| ***B26B 3/06*** | (2006.01) |
| ***B26B 5/00*** | (2006.01) |
| ***B26B 29/02*** | (2006.01) |

(52) U.S. Cl.

CPC .. *B26B 5/00* (2013.01); *B26B 29/02* (2013.01)

(58) Field of Classification Search

USPC ..... 30/151, 154, 156, 158, 162, 175, 286, 30/293–295

See application file for complete search history.

(56) References Cited

U.S. PATENT DOCUMENTS

| | | | | |
|---|---|---|---|---|
| 5,715,605 | A * | 2/1998 | Nadeau | 30/293 |
| 8,046,922 | B2 * | 11/2011 | Eby et al. | 30/151 |
| 8,127,452 | B2 * | 3/2012 | Garavaglia et al. | 30/2 |
| 8,720,068 | B2 * | 5/2014 | Landwehr | 30/2 |
| 2009/0271988 | A1 * | 11/2009 | Votolato | 30/158 |

* cited by examiner

*Primary Examiner* — Kenneth E. Peterson
*Assistant Examiner* — Nhat Chieu Do

(57) ABSTRACT

A hand cutter with a retractable blade guard providing an unimpaired view of the blade, when it is placed on the object. The blade guard is unlocked and retracted by a trigger mechanism, which is activated by closing the hand around the cutter handle. The blade guard remains in the retracted position until the trigger is released or a relocking mechanism is activated by putting the blade to use by cutting the object.

9 Claims, 4 Drawing Sheets

HAND CUTTER WITH BLADE GUARD

FIELD OF THE INVENTION

The present invention relates to a hand cutter with blade guard according to the preamble to Patent-claim 1.

BACKGROUND OF THE INVENTION

Hand cutters with safety features for protection are well known and have been present in the market for many years. The need for cutting tools with the highest possible protection for the user is increasing in today's market, where many goods are shipped throughout the world for which the packaging needs to be removed safely. Solutions range from low cost devices with integrated blades to more sophisticated hand cutters with replaceable blades. Several means are known for providing safe handling of the cutters, both for when these are in use, as well as when they are not in use. One common solution is to stow the cutting blade within the handle of the cutting tool when it is not in use. The blade is extended out of the handle for cutting before its use and can be stowed back in the handle after its use. Another known solution is the addition of a protective guard, which is placed over the blade, when the cutting tool is not in use.

A common solution for such a blade guard is to attach the guard to the handle at a pivot point, where it can be rotated between the extended position, where the blade is protected by the guard, and the retracted position, where the blade can be used for cutting. In order to protect the user from accidental cutting when the cutter is not in use, the blade guard of such knives is often permanently forced to the extended position by a spring. In order to allow cutting, the blade guard must be forced away from the extended position in which the blade is covered. This is commonly achieved by applying force to the blade guard. Various implementations of this are shown in U.S. Pat. Nos. 6,178,640, 6,578,266 and 6,718,637 where the blade guard is retracted by the force created when the blade guard makes contact to the object to be cut. This has the disadvantage that it is very difficult to position the cutting edge of the blade at an exact position on the object to be cut, since the cutting edge of the blade is blocked from the view of the user by the blade guard until actual contact with the object to be cut is made.

In addition the blade guard can create impressions or marks on the object to be cut if the spring forcing the blade guard to the closed position is too strong. This is not desirable if the cutter is used on a product that could be scratched such as a painted surface or if the object is very soft and can be deformed by the force of the blade guard. Another side effect of the known blade cutters using this mechanism is that when the force on the blade guard is suddenly released, e.g. when the cutter exits the object to be cut the spring immediately forces the blade guard back to the extended position. This creates a force on the pivot point of the blade guard and the blade guard itself and causes a vibration of the whole cutter. This vibration is absorbed by the users hand and can also cause damage to the object if the cutter is not moved away quickly.

SUMMARY OF THE INVENTION

The main object of the present invention is to provide an improved hand cutter with a retractable blade guard by allowing the user to retract the blade guard using a trigger mechanism, which moves the blade guard to the retracted position, so that the blade guard does not impair the view of the cutting edge of the blade, allowing a precise positioning of the cutting edge of the blade on the object to be cut.

Another object is to prevent the blade guard from coming into contact with the object to be cut, preventing marks or impressions on the object by the blade guard.

It is a further object of the invention to provide a means for moving the blade guard from the extended to the retracted position and back in a uniform controlled manner such that no sudden forces or vibrations on parts of the cutter and the users hand occur.

DETAILED DESCRIPTION OF THE INVENTION

Figure 1:
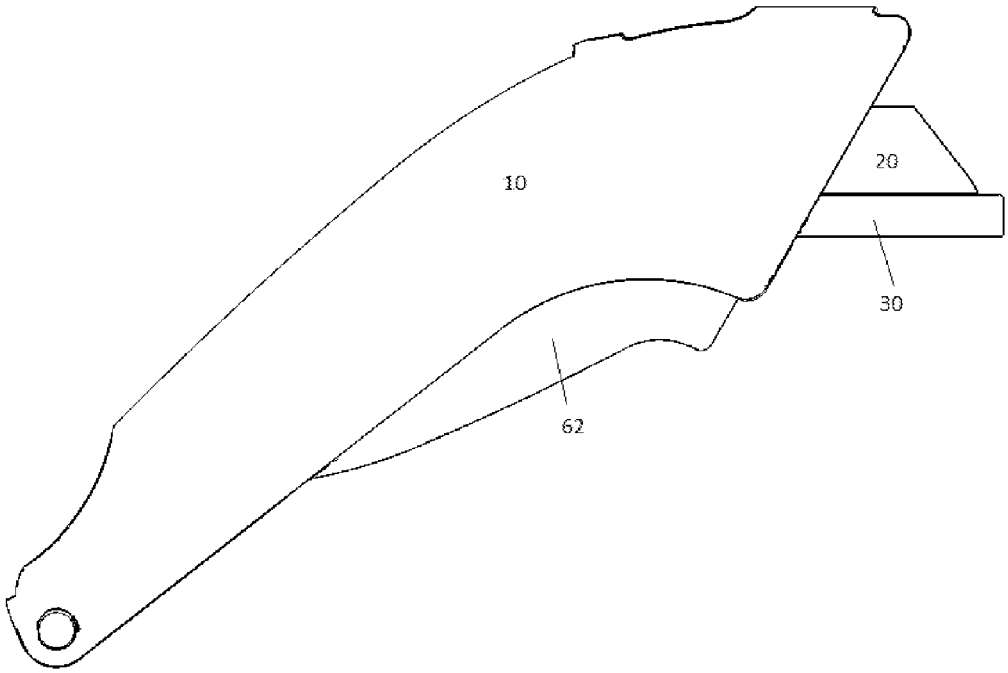
FIG. 1 is a side view of the hand cutter in the closed position

FIG. 1 is a side view of the outside of the hand cutter. The cutter consists of a housing 10, which has a trigger button 62 extending downwards on the lower part of the housing. At the front end of the cutter, a blade 20 extends from the housing 10 which is protected by a blade guard 30 when the hand cutter is not in use.

The housing 10 is formed such that it fits the users hand nicely and the trigger button 62 can be easily pushed by closing the hand or by forming a fist. Since no sliding motion is required to activate the trigger, the hand cutter can be easily held and used without a tiring effect even if the trigger button 62 is activated many times during the course of a day.

Figure 2:
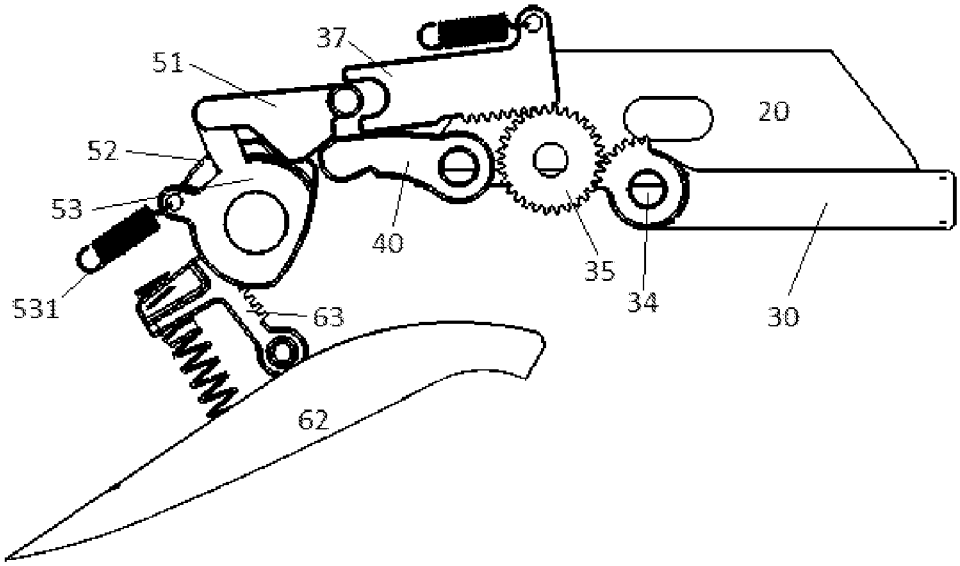
FIG. 2 is a side view of the inside of the hand cutter in the closed position
Figure 4:
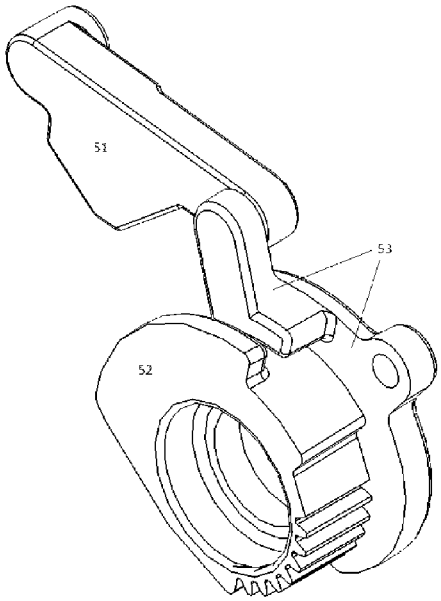
FIG. 4 is a perspective view of the release assembly

In FIG. 2 the inside of the hand cutter of the preferred embodiment is shown in the closed or protected position without the housing. It shows the trigger button 62 and a trigger rack arm 63 connected to the trigger button 62. The trigger rack arm 63 is pushed upwards as soon as the trigger button 62 is activated by the users' hand. Teeth at the front edge of the upper end of the trigger rack arm 63 interlock with a rack wheel 52 connected to the housing 10 so that the rack wheel 52 rotates clockwise as soon as the trigger rack arm 63 moves upwards. FIG. 4 shows a release wheel 53 which is coupled with the rack wheel 52 so that it rotates clockwise simultaneously. An arm extending from the upper part of the release wheel 53 is rotatably connected to the release piece 51. As soon as the release wheel 53 rotates clockwise, the release piece 51 is moved towards the front of the hand cutter.

Figure 3:
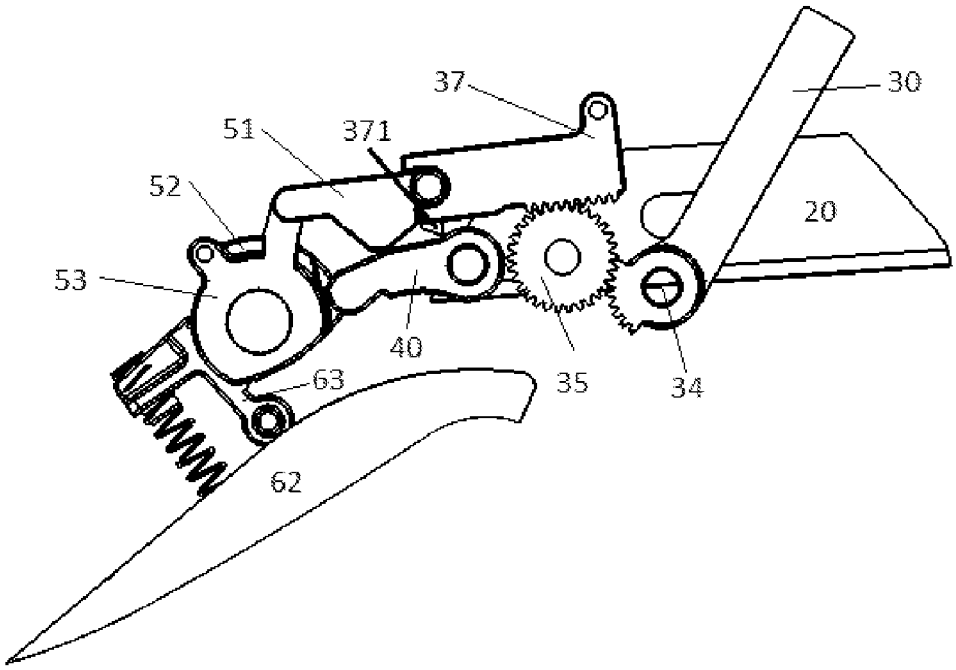
FIG. 3 is a side view of the inside of the hand cutter in the open position
Figure 5:
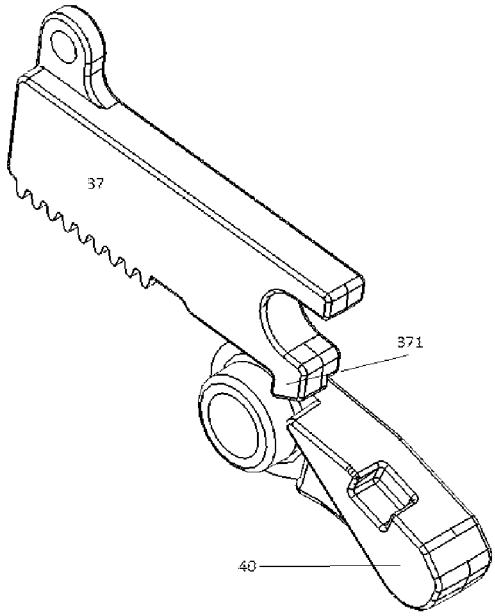
FIG. 5 is a perspective view of the lock mechanism

At the lower end of the release piece 51 an extension which is wider towards the back part of the hand cutter, pushes down the lock piece 40 as soon as the release piece 51 is moved forward, as can be seen in FIG. 3. The lock piece 40 is connected to the housing 10 at the front of the cutter, so that the rear part of the lock piece 40 can move downwards. The downward movement of the lock piece 40 releases the locking extension 371 at the lower rear end of a rack 37 from a notch in the lock piece 40 as shown in FIG. 5. The same forward movement of the release piece 51 pushes forward the rack 37 which is now free to move along the length of the cutter. At the lower front end of the rack 37 teeth are interlocked with a gear wheel 35. The forward movement of the rack 37 rotates the gear wheel 35 clockwise. Below the gear wheel 35 the rear end of the blade guard 30 is also equipped with teeth that are interlocked with the gear wheel 35. The clockwise rotation of the gear wheel 35 rotates the blade guard 30 counterclockwise, so that the front part of the blade guard 30 moves upwards around the pivot point 34. Through this upward movement of the blade guard 30, the blade 20 is no longer covered and the cutting edge of the blade is fully visible for an exact positioning on the object to be cut.

FIG. 3 shows the inside of the hand cutter in the open position. In this position the user has a clear view of the blade 20 and can position the cutting edge of the blade precisely at the desired spot, so that a cut can be made with great accuracy. As soon as the user releases the trigger button 62, the upwards force on the trigger rack arm 63 is released and the rack wheel 52 coupled to the release wheel 53 are rotated back counterclockwise. This rotation is enhanced by a spring connected to the release wheel 53 and allows the release piece 51 to move back to the original closed position. The rearward movement of the release piece 51 moves the extension at the lower end, used to force the lock piece 40 downwards, out of the reach of the lock piece 40. A spring forces the lock piece 40 back upwards to the original position so that the rack 37, which is forced rearward by an additional spring, can again be locked by means of the locking extension 371. At the same time, blade guard 30 is rotated back to the protected position via the gear wheel 35 which is rotated counterclockwise by the rack 37 during its rearward movement. In this way the blade 20 is again protected and the blade guard 30 locked as soon as soon as the trigger is released.

Figure 6:
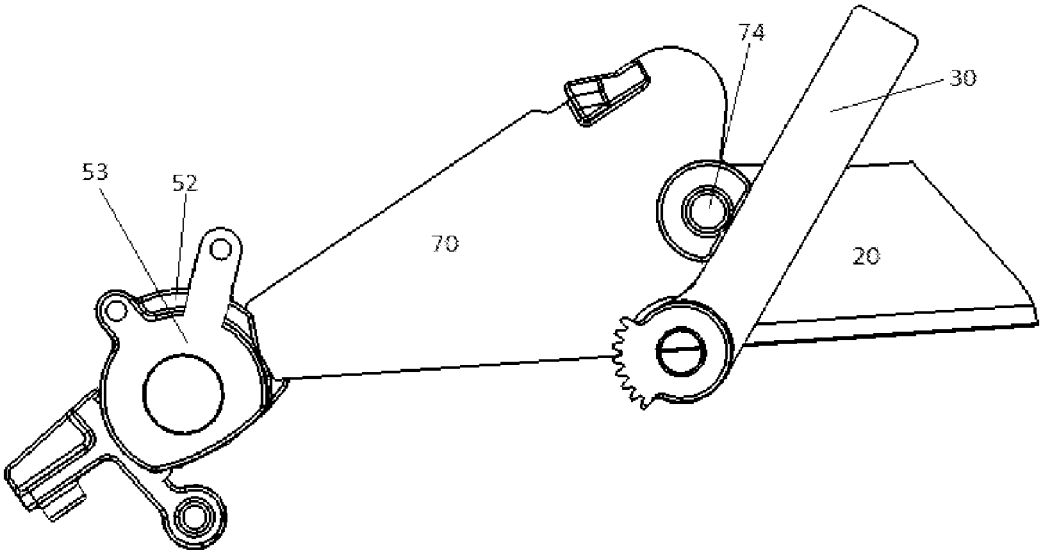
FIG. 6 is a side view of the inside of the hand cutter showing the blade holder
Figure 7:
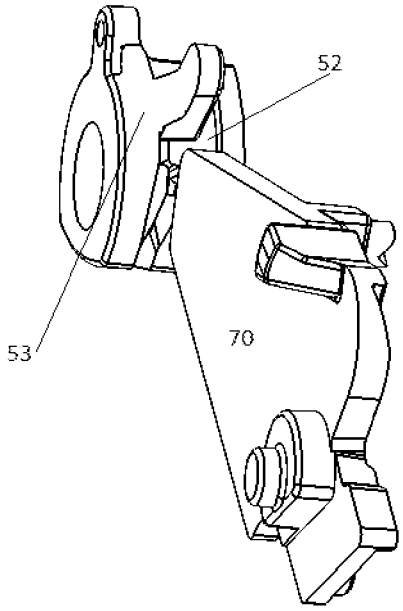
FIG. 7 is a perspective view of the blade holder and the release assembly

In order to protect the user of the cutter, a automatic relocking mechanism is added to the safety cutter. In FIG. 6 the blade holder 70 is shown together with the rack wheel 52 and the release wheel 53. As soon as the blade 20 is placed on the object to be cut, the front of the blade 20 is pushed slightly upwards and the rear end of the blade holder 70 moves downwards as it rotates around the blade holder pivot point 74. Through this downward movement, the blade holder 70, which extends to the rack wheel 52 and the release wheel 53, is forced between the two wheels. This pushes the rack wheel 52 and the release wheel 53 apart from each other so that the two wheels are decoupled. As soon as the rack wheel 52 and the release wheel 53 are decoupled, the release wheel 53 is forced to rotate counterclockwise, back to the original position, by a spring 531 as can be seen in FIG. 2. The rack wheel 52 remains in the same position as long as the trigger button 62 remains pushed. Due to the connection of the release wheel 53 with the release piece 51, the release piece 51 is pulled back to the original position so that the lock piece 40 is rotated back upwards by the spring. In this position the notch in the lock piece 40 returns to the original position, so that the locking extension 371 of the rack 37 can reengage with the notch as soon as the rack 37 moves back to the original position.

The blade guard 30 does not return to the protected position until the cutter is removed from the object to be cut. Until this occurs, the rack 37, which is forced towards the back end of the cutter by a spring, does not move completely to the original position, preventing the locking mechanism to reengage. As soon as the blade guard 30 returns all the way to the protected position, the rack 37 returns to the original position where the locking extension 371 reengages with the notch in the lock piece 40. In this state the blade 20 of the cutter is again protected even if the trigger button 62 is still being pressed, thus preventing accidental cutting after the cut has been completed.

The blade guard 30 remains in the locked position until the trigger button 62 is released and pressed again to activate the release mechanism.

The invention claimed is:

1. A hand cutter comprising
a housing
a blade
mounted detachably in the housing,
having a cutting edge,
a blade guard
mounted pivotally in the housing,
protecting the blade in a closed position and
exposing the cutting edge of the blade in an open position,
a release assembly comprising
a trigger button,
a trigger rack arm
wherein
said release assembly and said blade guard interact through a gear wheel which is connected to the housing and interlocks with teeth on said blade guard and teeth on a rack, said gear wheel moving the blade guard to the open position when it is rotated by forward movement of the rack, said rack releaseably connected to an outside part of a rack wheel, said rack wheel connected to the housing, with teeth interlocking with said trigger rack arm, said gear wheel, said rack and said rack wheel providing the connection between the trigger rack arm and the blade guard and moving the rack forward when the rack wheel is rotated as soon as the trigger button is activated, allowing the cutting edge to be positioned with great precision on an object to be cut, and said gear wheel moving the blade guard back to the closed position as soon as it is rotated back again.

2. The hand cutter of claim 1 further comprising
a lock mechanism preventing an accidental movement of said blade guard from a locked position
wherein
said lock mechanism further comprises
a lock piece which engages with the rack in the locked position, preventing any movement of the rack.

3. The hand cutter of claim 2 wherein
said lock piece has a notch,
and said rack has a locking extension at a lower part
which engages with said notch when the lock piece is in the locked position.

4. The hand cutter of claim 3 wherein said lock mechanism further comprises
a release piece connected to a rotatable wheel,
said release piece having an extension at a rear end which moves the lock piece away from the locked position, when it is moved forward, disengaging the lock mechanism and enabling the gear rack to move forward and backward.

5. The hand cutter of claim 4 wherein said rotatable wheel comprises
said rack wheel
having teeth
and interlocking with the teeth of said trigger rack arm,
a release wheel
coupled with the rack wheel
and connected to said release piece.

6. The hand cutter of claim 5 further comprising
a blade holder
mounted in the housing on a pivot point allowing a slight rotation of said blade holder and the blade
a decoupling means at the rear end of the blade holder
which connects to said rotatable wheel wherein a slight rotation of the blade holder which moves the rear end of the blade holder decouples the rack wheel and the release wheel of said rotatable wheel.

7. The hand cutter of claim 6 wherein said decoupling means at the rear end of said blade holder decouples the rack wheel and release wheel of said rotatable wheel by forcing the two wheels apart when the rear end of said blade holder is moved downwards.

8. The hand cutter of claim 7 wherein said decoupling means is activated by a force created as soon as the blade is used for cutting, by a slight upwards movement of the blade causing a small rotation of the blade holder around the pivot point.

9. The hand cutter of claim 8 wherein the decoupling of said rack and release wheels enables the blade guard to return to the closed position independently of the activation of the trigger button.

* * * * *